US010597934B2

(12) United States Patent
Gilbert

(10) Patent No.: US 10,597,934 B2
(45) Date of Patent: Mar. 24, 2020

(54) REVERSIBLE WINDOW SHUTTER

(71) Applicant: PLASTIC DEVELOPMENT GROUP, Southfield, MI (US)

(72) Inventor: Richard Gilbert, Castle Rock, CO (US)

(73) Assignee: PLASTIC DEVELOPMENT GROUP, Southfield, MI (US)

( * ) Notice: Subject to any disclaimer, the term of this patent is extended or adjusted under 35 U.S.C. 154(b) by 0 days.

(21) Appl. No.: 15/970,143

(22) Filed: May 3, 2018

(65) Prior Publication Data

US 2019/0338585 A1 Nov. 7, 2019

(51) Int. Cl.
*E06B 9/02* (2006.01)

(52) U.S. Cl.
CPC ..... *E06B 9/02* (2013.01)

(58) Field of Classification Search
CPC ..... E06B 9/02
USPC ..... 52/78, 202, 455, 457, 473; 49/74.1, 92.1
See application file for complete search history.

(56) References Cited

U.S. PATENT DOCUMENTS 3,494,073 A * 2/1970 Meddick ..... E06B 7/08 49/123
3,676,955 A * 7/1972 Schacht ..... E06B 3/34 49/192
D235,336 S * 6/1975 Lee ..... D25/48.1
3,950,904 A * 4/1976 Littman ..... E06B 9/02 52/105
4,041,644 A * 8/1977 Alcanzare ..... E06B 3/50 49/163
4,248,022 A * 2/1981 Walker ..... E04C 2/384 160/397
4,423,574 A * 1/1984 Pierre ..... E06B 9/02 49/63
4,765,110 A * 8/1988 MacLeod ..... E06B 9/04 52/473
5,265,391 A * 11/1993 Ricard ..... E06B 3/78 52/455
5,282,504 A * 2/1994 Anderson ..... E06B 9/01 160/107
5,540,018 A * 7/1996 Biggers ..... E06B 9/02 49/464
5,617,688 A * 4/1997 Gandy ..... E06B 7/082 52/473
5,826,393 A * 10/1998 Wenzlaff ..... E06B 7/082 52/473
5,857,298 A * 1/1999 Fullwood ..... E06B 3/00 52/202
5,865,562 A * 2/1999 Mallek ..... E06B 9/00 403/403

(Continued)

*Primary Examiner* — Joshua K Ihezie
(74) *Attorney, Agent, or Firm* — Brooks Kushman P.C.

(57) ABSTRACT

A reversible window shutter includes a frame and reversible panel inserts. The panel inserts can be attached to the frame in a first position in which a first side of the panel inserts are visible through the frame, and a second position in which a second side of the panel inserts are visible through the frame. Each side of the panel inserts can have a different design or style, giving the user the ability to change the visible style of the window shutter. Each panel inserts may be a two-part insert, with each panel insert part having an outer surface with a decorative design, and an inner surface with connection features configured to engage the connection features of the other panel insert part.

12 Claims, 5 Drawing Sheets

(56) References Cited

U.S. PATENT DOCUMENTS 5,941,031 A * 8/1999 Fullwood ..... E06B 3/00 52/202
6,131,867 A * 10/2000 Mallek ..... E06B 9/00 248/261
6,560,941 B1 * 5/2003 French ..... E06B 7/08 52/473
8,336,270 B2 * 12/2012 Vagedes ..... E06B 9/04 52/455
8,966,839 B2 * 3/2015 Rebman ..... E06B 3/28 52/202
2003/0009946 A1 * 1/2003 Wilson ..... E06B 7/09 49/74.1
2003/0041978 A1 * 3/2003 Farooq ..... E06B 9/581 160/133
2005/0055929 A1 * 3/2005 Rude ..... E06B 7/08 52/473
2005/0193651 A1 * 9/2005 Kirk ..... E06B 9/04 52/202
2005/0204664 A1 * 9/2005 Snyder ..... E04F 17/04 52/302.1
2007/0290106 A1 * 12/2007 Spivey ..... E06B 9/02 248/208
2010/0146881 A1 * 6/2010 Framer ..... E06B 9/02 52/202
2010/0251635 A1 * 10/2010 Barnard ..... E06B 3/485 52/127.6
2011/0197539 A1 * 8/2011 Marocco ..... E06B 7/086 52/656.7
2012/0069553 A1 3/2012 Bauer
2013/0180188 A1 * 7/2013 Motosko, II ..... E06B 9/02 52/202
2016/0069128 A1 * 3/2016 Koenitz ..... E06B 9/02 160/351
2017/0156499 A1 6/2017 Kane et al.

* cited by examiner

REVERSIBLE WINDOW SHUTTER

TECHNICAL FIELD

This disclosure generally relates to a window shutter for a home, wherein the window shutter has reversible panels enabling a user to reverse or replace the window panels to change the visible appearance of the window shutter.

BACKGROUND

Window shutters serve as an ornamental feature on the sides of windows of residential or commercial buildings. Window shutters are sold in various sizes, styles, colors, and designs. However, if a homeowner decides to update or change the style of the window shutters, the homeowner is left with the option of removing the window shutter, discarding or storing that window shutter, buying a new window shutter, and installing the new window shutter. This can be a time consuming and expensive procedure to update the look of the house.

SUMMARY

In one embodiment, a reversible window shutter includes a frame having a front surface, a rear surface, and a lip extending rearward about a perimeter of the front surface. The frame further defines an opening extending through the frame, wherein the frame includes a plurality of projections extending rearward from the rear surface about the opening, each projection defining a receptacle. A panel insert has a front surface, a rear surface, and a perimeter surface extending between the front and rear surfaces. The panel insert includes a plurality of projections extending outwardly from the perimeter surface, each projection of the panel insert including an aperture. When the panel insert is assembled to the frame, the apertures of the projections of the panel insert each align with a respective one of the receptacles of the projections of the frame, such that fasteners may extend through the apertures and into the receptacles to removably fasten the panel insert to the rear surface of frame.

In another embodiment, a reversible window shutter includes a frame, and a two-part panel insert configured to attach to the frame. The two-part panel insert has a first panel part having a first side and a second side, the first side of the first panel part defining a plurality of projections extending outwardly therefrom. The two-part panel insert also has a second panel part having a first side and a second side, the first side of the second panel part defining a plurality of pockets configured to receive the projections with an interference fit.

In another embodiment, a reversible window shutter includes a one-piece frame including an opening, a front surface, and a rear surface. A panel insert is assembled to the frame at a location aligned with the opening. The panel insert has a first side and a second side. The panel insert is removably connected to the frame and is reversible from a first position with the first side facing forward through the opening to a second position with the second side facing forward through the opening.

DETAILED DESCRIPTION

Embodiments of the present disclosure are described herein. It is to be understood, however, that the disclosed embodiments are merely examples and other embodiments can take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures can be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Window shutters are typically fastened or attached to a house initially during the final stages of construction of the house, or during a renovation of the exterior of the home. The process for securing or replacing window shutters can be time consuming and expenses. This makes it difficult or costly for a homeowner to replace window shutters. Moreover, once the shutters are replaced, it is again timely and/or expensive to replace them yet again; this forces homeowners to be stuck with the window shutters that they have on their house for a long time.

According to various embodiments disclosed herein, a reversible window shutter 10 is provided. The reversible window shutter 10 has panels that can be assembled, replaced, reversed, and re-assembled easily and quickly. This allows the homeowner to replace the outside appearance of the window shutter in a much more convenient manner.

Figure 1:
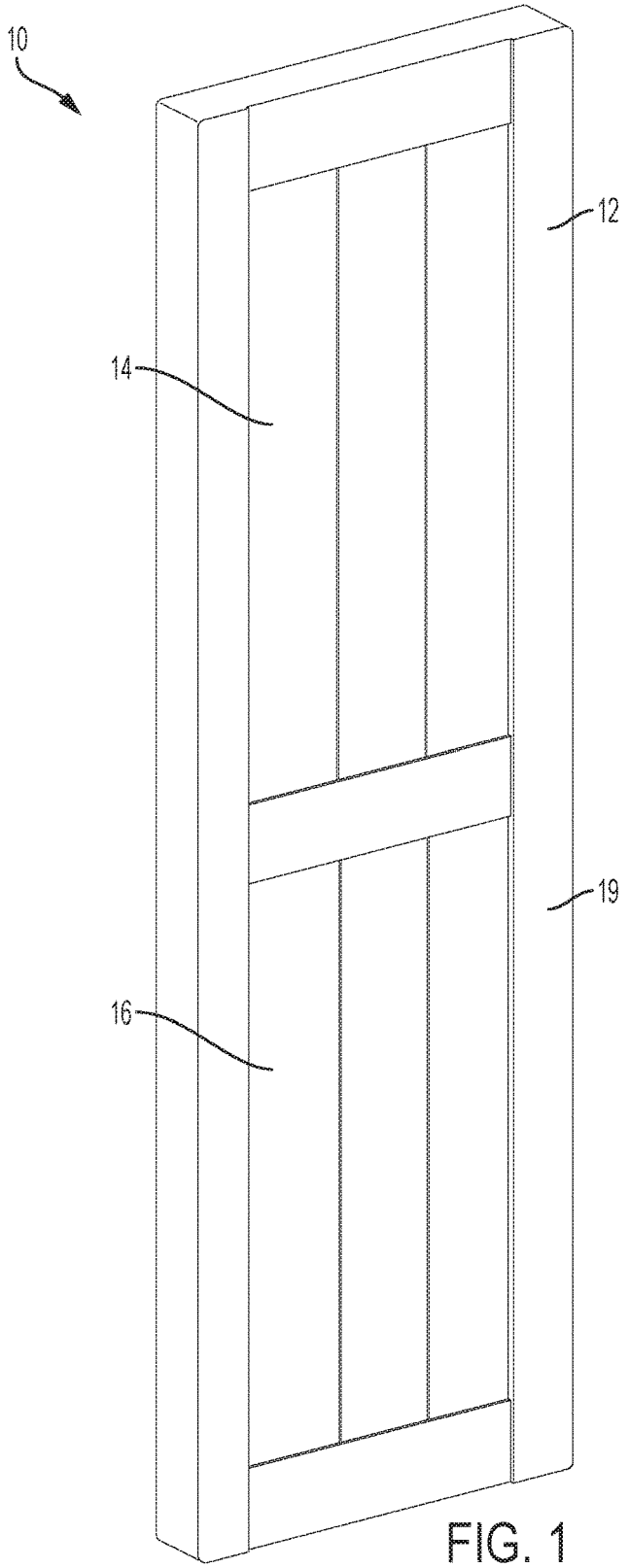
FIG. 1 is a front perspective view of a reversible window shutter, according to one embodiment.

FIG. 1 shows a perspective view of the outside or front of the window shutter 10, according to one embodiment. As will be further described below, the window shutter 10 includes a frame 12 and two panel inserts, namely a top panel insert 14 and a bottom panel insert 16. The frame 12 is generally rectangular and defines two rectangular openings, one on top of the other. The panel inserts 14, 16 are assembled to the rear side of the frame 10 such that they are visible through the openings.

Figure 2:
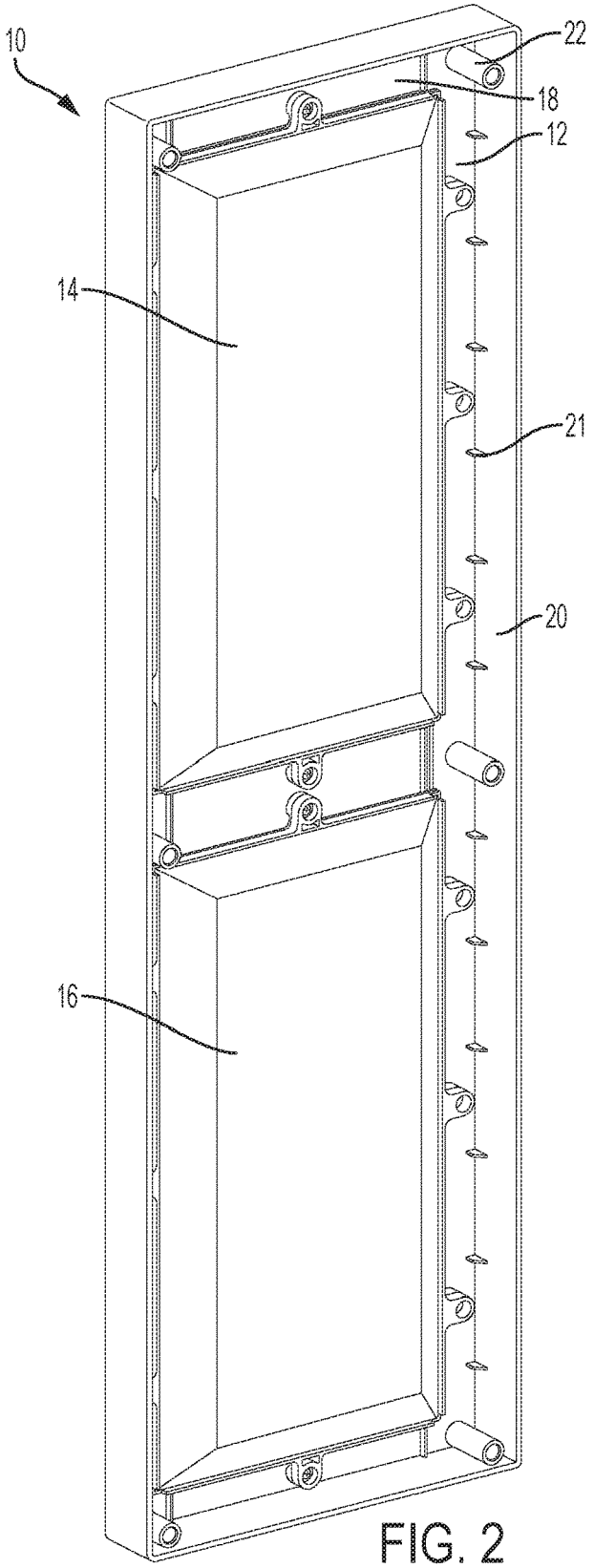
FIG. 2 is a rear perspective view of the reversible window shutter of FIG. 1, according to one embodiment.

Being reversible, the panel inserts 14, 16 can have two different designs or ornamental appearance. For example, when assembled to the frame, the visible side of the panel inserts (visible from the front of the window shutter 10) can be one design, while the rear side of the panel inserts (not visible from the front of the window shutter 10) can be another design. Referring to FIGS. 1 and 2, the front side of the panels is a rustic style design, and the back side of the panels is a raised panel design. The shutter 10 is not limited to only these designs; the front side or rear side of each panel can be one of many other styles or designs known, such as louvered, shaker, plantation, board and batten, Scandinavian, cut-out, café, combination (e.g., half one style, half another style), or any other styles.

FIG. 2 shows a perspective view of the inside or rear of the window shutter. The frame 12 has a rear side 18 to which the panel inserts 14, 16 are attached. Surrounding the rear side 18 and the border or perimeter of the frame 12 is a lip 20 extending rearwardly from the front side 19 of the frame. Stiffening ribs or support ribs 21 can be provided at the intersection of the lip and the rear side of the frame 12. As the frame 12 can be made of plastic via injection molding, the support ribs 21 can be provided during the manufacturing process to provide additional support for the lip 20.

The panel inserts 14, 16 are located within the confines of the lip 20 when properly assembled to the frame 12. Also extending from the rear side of the window shutter are a plurality of pegs 22 with receptacles configured to receive shipping plugs (not shown). When the window shutters are shipped, a pair of window shutters can be packaged together with their rear sides facing one another, and a single shipping plug can be inserted into aligned pegs 22 of the two packaged shutters. This keeps separation between the two packaged shutters, while also binding them together.

Figure 3:
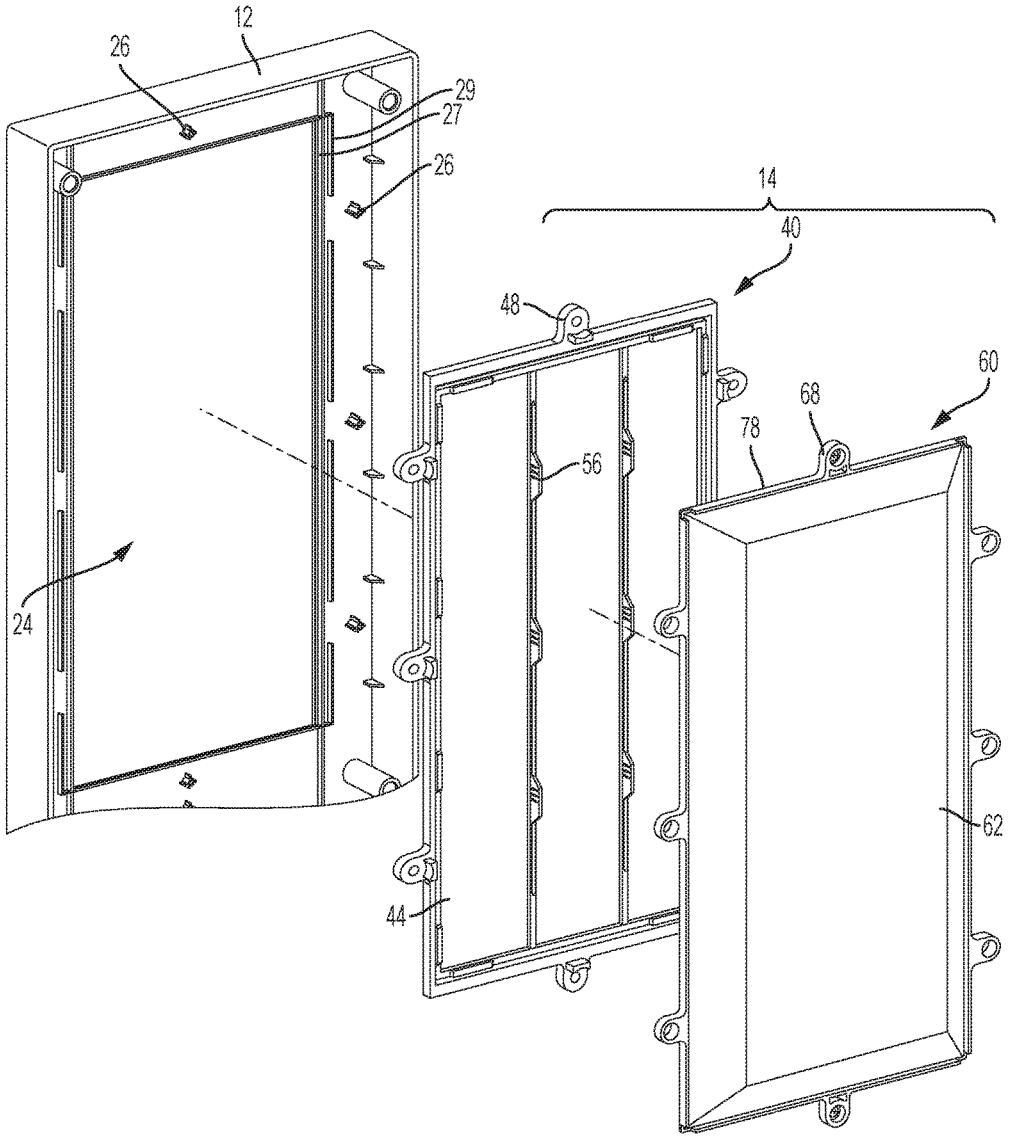
FIG. 3 is a rear exploded perspective view of a portion of the reversible window shutter, showing one panel having two panel parts assembled to each other and to a frame of the window shutter, according to one embodiment.

FIG. 3 shows an exploded perspective view of a top portion of the frame 12, as well as the top panel insert 14. The top panel insert 14 is a two-part panel insert, with a first panel part 40 and a second panel part 60. The first panel part 40 and the second panel part 60 assemble to one another and to the frame 12. The first panel part 40 is shown in isolation in FIG. 4, and the second panel part 60 is shown in isolation in FIG. 5.

Referring to FIGS. 2-5, the frame 12 defines a top opening 24 to which the top panel insert 14 aligns with during assembly. On the rear side of the frame 12 are a plurality of projections 26 extending rearwardly, away from the front surface of the frame 12. Each projection 26 has a receptacle or pocket configured to receive a fastener such as a screw. The projections are configured to locate and attach the panel parts 40, 60 to the frame 12. In particular, the first panel part 40 includes a front surface 42, a rear surface 44, and a perimeter surface 46 between and adjoining the front surface 42 and the rear surface 44. A plurality of projections 48 (also referred to as mounting protrusions) extend outwardly from the perimeter surface 46. Each of the projections 48 can define a corresponding aperture 50. The aperture 50 is sized and configured to receive one of the projections 26 of the frame 12, with the apertures 50 of the projections 48 aligning with the receptacles of the projections 26. Likewise, the second panel part 60 includes a front surface 62, a rear surface 64, and a perimeter surface 66 between and adjoining the front surface 62 and the rear surface 64. A plurality of projections 68 (also referred to as mounting protrusions) extend outwardly from the perimeter surface 66. Each of the projections 68 can define a corresponding aperture 70. The aperture is also sized and configured to receive one of the projections 26 of the frame 12, with the apertures 70 of the projections 68 aligning with the receptacles of the projections 26.

To assemble the first panel part 40 to the frame 12 so that the first side 42 of the first panel part 40 is facing outward through the opening 24, the projections 26 of the frame 12 are inserted into the apertures 50 of the projections 48 of the first panel part 40. Then, the second panel part 60 can be assembled to the first panel part 40 with the projections 68 of the second panel part 60 aligning with the projections 48 of the first panel part 40 and with the projections 26 of the frame. The projections 26 of the frame may only be long enough to extend into or through the first panel part 40 but not into or through the second panel part 60. Fasteners such as screws or the like can be inserted through the aligned apertures 50, 70 and into the receptacle of the projection 26, as shown in the assembled view in FIG. 2.

To reverse the window shutter, the fasteners are removed and the panel insert 14 is removed from the frame 12. The panel insert 14 can be flipped over so that the front surface 62 of the second panel part 60 faces through the opening 24 rather than the front surface 42 of the first panel part 40. The fastener can then be reattached through the apertures 50, 70 and into the receptacles of the projections 26. The reversible window shutter has now changed from having a first design (e.g., rustic) to a second design (e.g., raised panel).

The panel parts can also be interchanged with other panel parts. In particular, the first panel part 40 can be removed from the second panel part 60 and replaced by another first panel part with a different style of shutter design. Likewise, the second panel part 60 can be removed from the first panel part 40 and replaced by another second panel part with a different style of shutter design. This provides the user with the ability to customize the two designs of panel inserts that are assembled to the frame 12.

The first panel part 40 and the second panel part 60 may have various attachment features to help secure the panel parts 40, 60 to each other in mechanical ways other than the fasteners explained above. For example, in one embodiment, the first panel part 40 has a plurality of projections 52 extending rearwardly from the mounting protrusions 48. These projections 52 can be curved pegs, being concave on either or both side of the projections. The second panel part 60 can have corresponding pockets 72 formed within the projections 68. The pockets 72 are sized and configured to receive the projections 52. In one embodiment, the projections 52 and the pockets 72 are connected with an interference fit.

Figure 4:
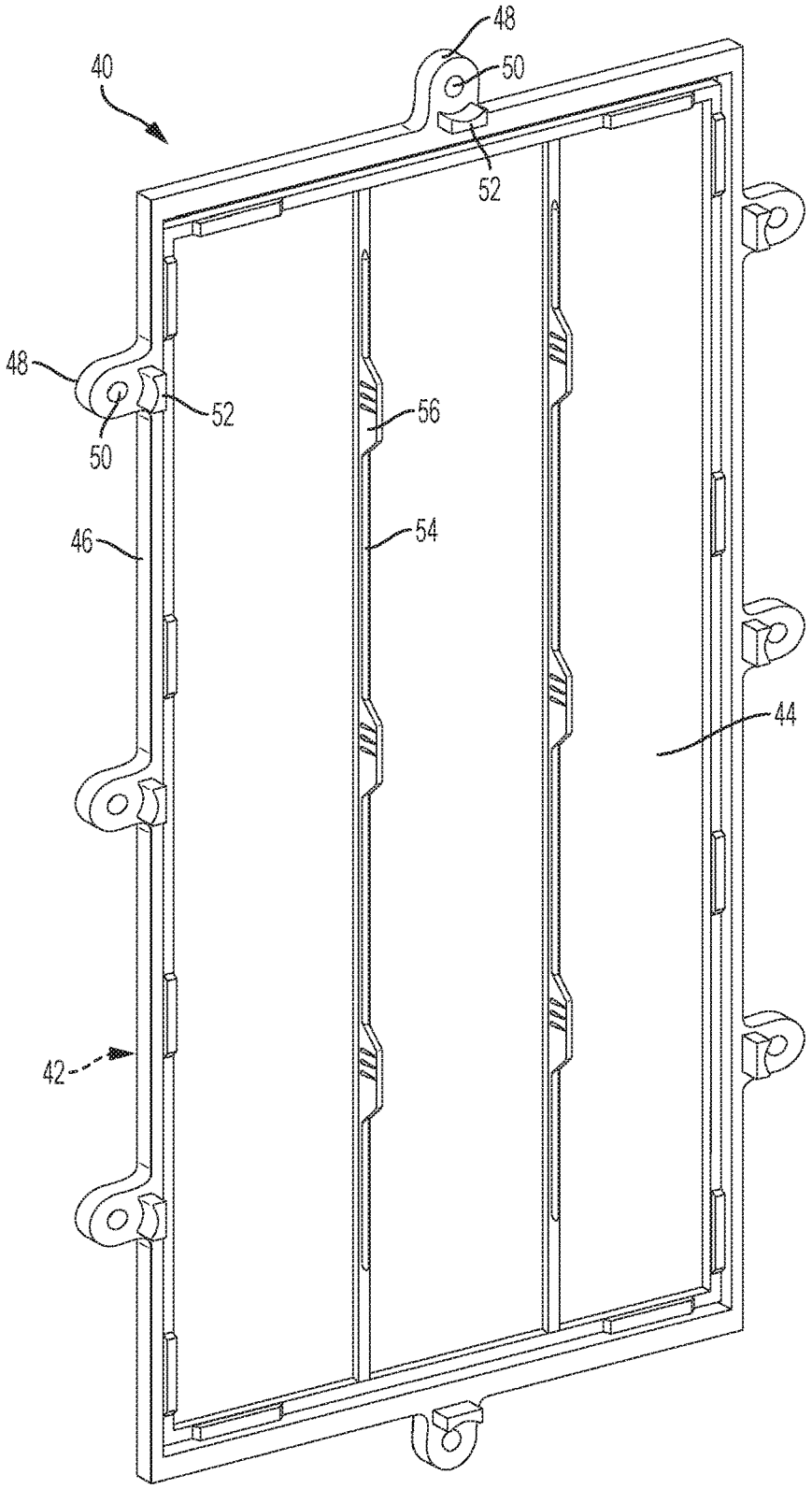
FIG. 4 is a rear perspective view of a first panel part, according to one embodiment.
Figure 5:
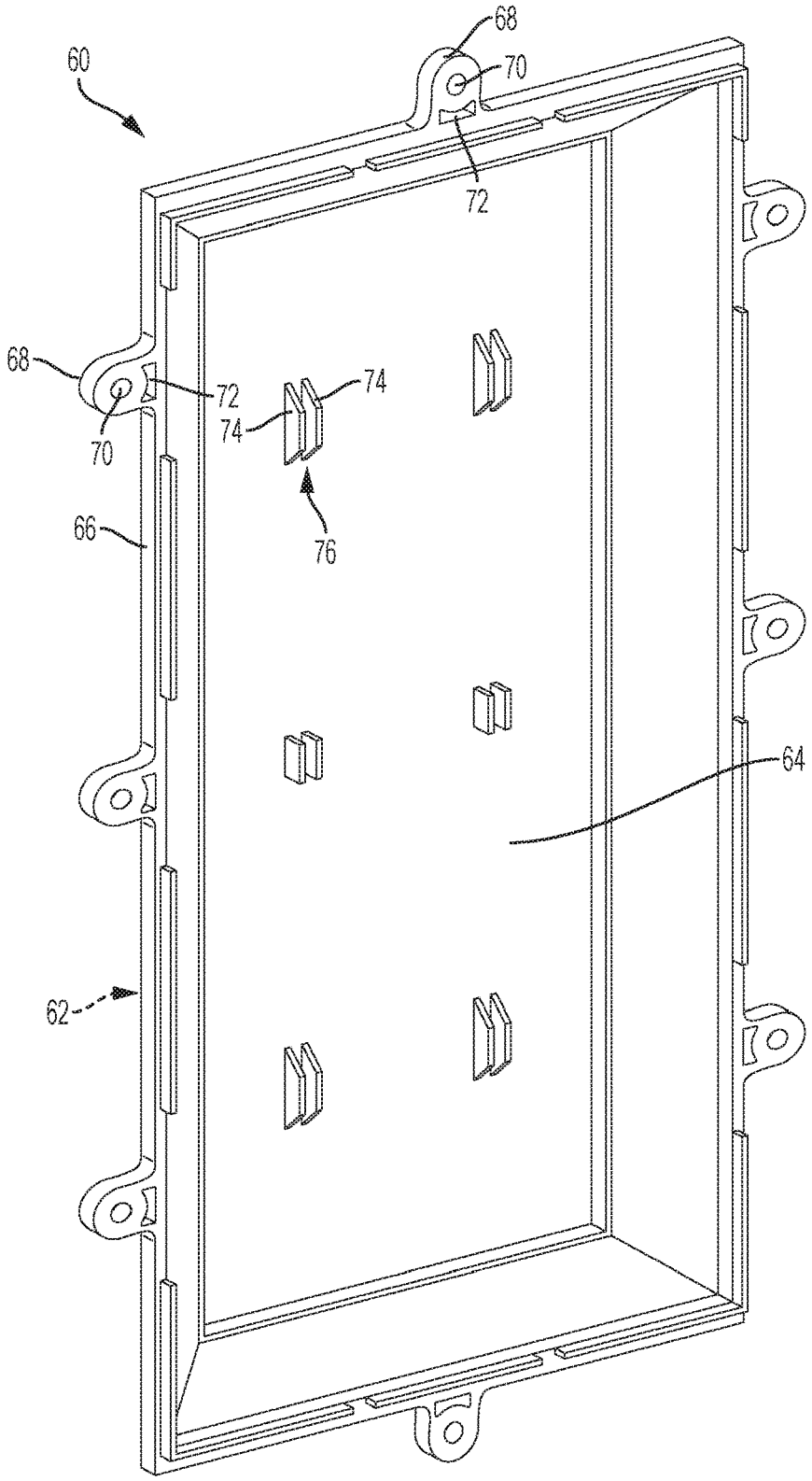
FIG. 5 is a rear perspective view of a second panel part configured to assemble to the first panel part, according to one embodiment.

To further attach the first panel part 40 to the second panel part 60, the rear surface 44 within the perimeter of the first panel part 40 can be attached to the rear surface 64 within the perimeter of the second panel part 60. In particular, the first panel part 40 may include one or more ribs 54 extending between and connecting a top lip and a bottom lip of the first panel part 40. The ribs 54 may be integrally formed with the rear surface 44 of the first panel part 40. Each rib may have one or more projection 56 (also referred to as a fin) extending rearwardly therefrom. The projections may be wedge-shaped, with tapered sides on either top and bottom sides of the projections, as shown in FIG. 4. The second panel part 60 may include one or more pockets or receptacles 76 configured to receive the projections 56. The receptacles 76 may be bound between or include a pair or projections 74 (also referred to as fins). At least a portion of the width between the projections 74 may be equal to or less than at least a portion of the width of the corresponding projection 56, thus providing an interference fit between the projections 56 and the receptacles 76. This allows the rear or inner surfaces of the first and second panel parts to snap-fit to one another.

Each panel part may be provided with various flanges, ledges, or lips configured to engage with the frame about the openings 24 in the frame 12. In particular, according to one embodiment, the frame 12 may include a lip 27 extending rearward from the rear surface 18. The lip 27 surrounds a perimeter of the opening 24. The frame 12 may also include a rail 29 spaced outwardly from the lip to define a slot therebetween. Each panel part 40, 60 may have corresponding surface features that engage with the lip when assembled to the frame 12. For example, the second panel part 60 may have a flange 78 extending forwardly from the front side of the panel part 60, as shown in FIG. 3. When assembled, the flange 78 can rest in the slot between the lip 27 and the rail 29. This allows the top horizontal section of the lip 27 to support the top horizontal section of the flange 78 from beneath. Meanwhile, the first panel part 40 may have a shoulder ledge formed into the outer perimeter of the front surface 42 that contacts and is located inwardly of the lip 27. This allows the top horizontal section of the shoulder to support the top horizontal section of the lip 27 from beneath.

The frame 12 and both panel inserts 14, 16 can all be made of plastic, particularly injection-molded plastic. This creates a substrate that is solid plastic throughout and gives the ability to easily customize the molds to take a desired shape. Plastic allows the reversible window shutter to be mold, mildew, and rot resistant, which is desirable for an apparatus that is exposed to the elements as much as a window shutter is. In another embodiment, the frame and both panel inserts are made of blow-molded plastic.

The reversibility of the window shutter 10 of this disclosure can reside in the panel inserts, not the frame. In other words, in one embodiment, the panel inserts are reversible relative to the frame, which is attached to the home in the same orientation and position regardless of the orientation and position of the panel inserts. Also, no part of the panel inserts are required to be attached to the home directly, but can instead remain directly attached to only the frame, which can be attached to the home directly.

While exemplary embodiments are described above, it is not intended that these embodiments describe all possible forms encompassed by the claims. The words used in the specification are words of description rather than limitation, and it is understood that various changes can be made without departing from the spirit and scope of the disclosure. As previously described, the features of various embodiments can be combined to form further embodiments of the invention that may not be explicitly described or illustrated. While various embodiments could have been described as providing advantages or being preferred over other embodiments or prior art implementations with respect to one or more desired characteristics, those of ordinary skill in the art recognize that one or more features or characteristics can be compromised to achieve desired overall system attributes, which depend on the specific application and implementation. These attributes can include, but are not limited to cost, strength, durability, life cycle cost, marketability, appearance, packaging, size, serviceability, weight, manufacturability, ease of assembly, etc. As such, to the extent any embodiments are described as less desirable than other embodiments or prior art implementations with respect to one or more characteristics, these embodiments are not outside the scope of the disclosure and can be desirable for particular applications.

What is claimed is:

1. A reversible window shutter comprising:

a frame; and a two-part panel insert configured to attach to the frame, the two-part panel insert having a first panel part having a first side and a second side, the first side of the first panel part defining a plurality of projections extending outwardly therefrom, wherein the first panel part includes a perimeter edge and a first plurality of mounting protrusions extending outwardly therefrom, each of the first plurality of mounting protrusions defining an aperture extending therethrough, and a second panel part having a first side and a second side, the first side of the second panel part defining a plurality of pockets configured to receive the projections with an interference fit, the second panel part includes a perimeter edge and a second plurality of mounting protrusions extending outwardly therefrom, each of the second plurality of mounting protrusions defining an aperture extending therethrough and aligned with a respective one of the apertures of the first panel part; and a fastener extending through one of the apertures of the first panel part, one of the apertures of the second panel part, and into the frame.

2. The reversible window shutter of claim 1, wherein at least one of the first plurality of mounting protrusions includes a peg, and at least one of the second plurality of mounting protrusions includes a pocket configured to receive the peg.

3. The reversible window shutter of claim 1, Wherein at least some of the plurality of projections extend from a linear rib on the first side of the first panel part.

4. The reversible window shutter of claim 1, wherein the first side of the second panel part includes a plurality of pairs of fins extending therefrom, each pair of fins defining one of the pockets therebetween.

5. The reversible window shutter of claim 4, wherein each of the projections fits between a respective one of the pairs of fins with an interference fit.

6. A reversible window shutter comprising:

a one-piece frame including an opening, a front surface and a rear surface; and a panel insert assembled to the frame at a location aligned with the opening, the panel insert having a first side and a second side, wherein the panel insert is removably connected to the frame and is reversible from a first position with the first side facing forward through the opening to a second position with the second side facing forward through the opening;

wherein the frame includes a lip extending from the rear surface and at least partially surrounding a perimeter of the opening, and wherein the first side of the panel insert includes a flange extending therefrom along a top edge of the panel insert, the flange being supported above the lip when the panel insert is connected to the frame in the first position.

7. The reversible window shutter of claim 6, wherein:

the frame further includes a rail extending from the rear surface, the rail and the lip cooperate to define a slot, the flange is a first flange configured to be inserted into the slot when the panel insert is connected to the frame in the first position, and the second side of the panel insert includes a second flange configured to be inserted into the slot when the panel insert is connected to the frame in the second position.

8. The reversible window shutter of claim 6, wherein the panel insert is a two-piece panel insert having a first panel part having a first side and a second side, the first side of the first panel part defining a plurality of projections extending outwardly therefrom, and a second panel part having a first side and a second side, the first side of the second panel part defining a plurality of pockets configured to receive the projections to connect the first panel and the second panel with an interference fit.

9. The reversible window shutter of claim 8, wherein the first panel part includes a perimeter having a first plurality of mounting projections extending therefrom, each of the first plurality of mounting protrusions defining an aperture, and wherein the second panel part includes a perimeter having a second plurality of mounting projections extending therefrom, each of the second plurality of mounting protrusions defining an aperture aligned with a respective aperture of the first plurality of mounting protrusions.

10. The reversible window shutter of claim 6, wherein the panel insert includes a perimeter having a plurality of mounting projections extending therefrom, each mounting projection defining an aperture aligned with a corresponding pocket in the frame for receiving a fastener through the panel insert and into the frame.

11. A reversible window shutter comprising:

a one-piece frame including an opening, a front surface and a rear surface; and a panel insert assembled to the frame at a location aligned with the opening, the panel insert having a first side and a second side, wherein the panel insert is removably connected to the frame and is reversible from a first position with the first side facing forward through the opening to a second position with the second side facing forward through the opening;

wherein:

the frame includes a lip extending from the rear surface and at least partially surrounding a perimeter of the opening, the frame further includes a rail extending from the rear surface, the rail and the lip cooperate to define a slot, the first side of the panel insert includes a first flange configured to be inserted into the slot when the panel insert is connected to the frame in the first position, and the second side of the panel insert includes a second flange configured to be inserted into the slot when the panel insert is connected to the frame in the second position.

12. The reversible window shutter of claim 11, wherein the panel insert is a two-piece panel insert having a first panel part having a first side and a second side, the first side of the first panel part defining a plurality of projections extending outwardly therefrom, and a second panel part having a first side and a second side, the first side of the second panel part defining a plurality of pockets configured to receive the projections to connect the first panel and the second panel with an interference fit.

* * * * *